US007368078B2

(12) United States Patent
Nakabayashi et al.

(10) Patent No.: US 7,368,078 B2
(45) Date of Patent: May 6, 2008

(54) METAL POWDER PRODUCTION APPARATUS

(75) Inventors: Koei Nakabayashi, Hachinohe (JP); Mitsutoyo Tanaka, Chino (JP); Tokihiro Shimura, Hachinohe (JP); Yoshinari Tanaka, Hachinohe (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 11/641,520

(22) Filed: Dec. 19, 2006

(65) Prior Publication Data

US 2007/0138713 A1 Jun. 21, 2007

(30) Foreign Application Priority Data

Dec. 20, 2005 (JP) ..... 2005-367227

(51) Int. Cl.
*C21C 1/00* (2006.01)
*B22F 1/00* (2006.01)

(52) U.S. Cl. ..... 266/202; 75/343

(58) Field of Classification Search ..... 266/202; 75/343

See application file for complete search history.

(56) References Cited

U.S. PATENT DOCUMENTS 3,588,951 A 6/1971 Hegmann
4,416,600 A * 11/1983 Lecznar et al. ..... 425/7
4,624,409 A 11/1986 Takeda et al.
5,289,975 A 3/1994 Miller et al.
5,366,204 A 11/1994 Gigliotti
5,656,061 A 8/1997 Miller
6,533,563 B1 * 3/2003 Otaigbe et al. ..... 425/6

FOREIGN PATENT DOCUMENTS

GB 2155048 2/1984
JP 03-55522 8/1991

* cited by examiner

*Primary Examiner*—Scott Kastler
(74) *Attorney, Agent, or Firm*—Harness, Dickey & Pierce, P.L.C.

(57) ABSTRACT

A metal powder production apparatus includes a supply part for supplying molten metal and a nozzle provided below the supply part. The nozzle is provided with a flow path through which the molten metal supplied from the supply part can pass, the flow path having a gradually reducing inner diameter portion whose inner diameter is gradually reduced in a downward direction. The nozzle is further provided with an orifice opened at a bottom end of the flow path and adapted to inject fluid toward the flow path. The nozzle has a first member and a second member provided below the first member with a space left between the first member and the second member, wherein the orifice is defined by the first member and the second member. A clamp for restraining the orifice from being enlarged by the pressure of the fluid passing through the orifice is provided on the nozzle.

13 Claims, 5 Drawing Sheets

METAL POWDER PRODUCTION APPARATUS

CROSS-REFERENCE TO RELATED APPLICATION

This application claims a priority to Japanese Patent Application No. 2005-367227 filed on Dec. 20, 2005 which is hereby expressly incorporated by reference herein in its entirety.

BACKGROUND

1. Technical Field

The present invention relates to a metal powder production apparatus for producing metal powder from molten metal.

2. Related Art

Conventionally, a metal powder production apparatus (atomizer) that pulverizes molten metal into metal powder by an atomizing method has been used in producing metal powder. Examples of the metal powder production apparatus known in the art include a molten metal atomizing and pulverizing apparatus disclosed in JP-B-3-55522.

The molten metal atomizing and pulverizing apparatus is provided with a molten bath nozzle for ejecting molten bath (molten metal) in a downward direction and a water nozzle having a flow path through which the molten bath ejected from the molten bath nozzle passes and a slit opened into the flow path. Water is injected from the slit of the water nozzle.

The apparatus of the prior art mentioned above is designed to produce metal powder by bringing the molten bath passing through the flow path into collision with the water injected from the slit to thereby disperse the molten bath in the form of a multiplicity of fine liquid droplets and then allowing the multiplicity of fine liquid droplets to be cooled and solidified.

However, in the apparatus of the prior art mentioned above, the clearance of the slit is excessively enlarged by the pressure of the water flowing therethrough. As a result, water pressure is dropped in the water nozzle. This water pressure drop causes a problem of overly reducing the flow velocity of the water injected from the slit. Therefore, since the ability for the fast-flowing water to pulverize the molten bath is decreased, fine-sizing of the metal powder cannot be made. This makes it difficult to obtain fine powder of a desired particle size.

SUMMARY

Accordingly, it is an object of the present invention to provide a metal powder production apparatus capable of maintaining a flow velocity of fluid injected from an orifice nearly constant in a reliable manner.

One aspect of the invention is directed to a metal powder production apparatus. The metal powder production apparatus comprises a supply part for supplying molten metal and a nozzle provided below the supply part. The nozzle includes a flow path defined by an inner circumferential surface of the nozzle through which the molten metal supplied from the supply part can pass, the flow path having a gradually reducing inner diameter portion whose inner diameter is gradually reduced in a downward direction, and an orifice opened at a bottom end of the flow path and adapted to inject fluid toward the flow path.

The molten metal is dispersed and turned into a multiplicity of fine liquid droplets by bringing the molten metal passing through the flow path into contact with the fluid injected from the orifice of the nozzle, so that the multiplicity of fine liquid droplets are solidified to thereby produce metal powder.

Further, the nozzle includes a first member and a second member provided below the first member with a space left between the first member and the second member. The orifice is defined by the first member and the second member. A restraint means for restraining the orifice from being enlarged by the pressure of the fluid passing through the orifice is provided on the nozzle.

This makes it possible to maintain the flow velocity of the fluid injected from the orifice nearly constant in a reliable manner.

It is preferred that the orifice is opened in a circumferential slit shape extending over the inner circumferential surface of the nozzle.

This ensures that the fluid is injected in a generally conical contour with an apex thereof lying definitely at the lower side.

It is preferred that the orifice has an inner circumferential surface defined by an end portion of the first member and an outer circumferential surface defined by an end portion of the second member.

This makes it possible to easily and reliably form the orifice. Furthermore, the size of the orifice can be properly set in accordance with the size of the space left between the first member and the second member.

It is preferred that the orifice is configured to ensure that the fluid is injected in a generally conical contour with an apex lying at a lower side.

This ensures that the molten metal is dispersed within the fluid injected in a generally conical contour and is turned to a multiplicity of fine liquid droplets in a reliable manner.

It is preferred that the nozzle further includes a retention portion for temporarily retaining the fluid, and an introduction path for introducing the fluid from the retention portion to the orifice, the introduction path having a vertical cross-section of a wedge shape.

This makes it possible to gradually increase the flow velocity of the fluid. It is also possible to stably inject the fluid having an increased velocity from the orifice.

It is preferred that the gradually reducing inner diameter portion is of a convergent shape.

This ensures that the air subsisting above the nozzle flows into (or is sucked up into) the gradually reducing inner diameter portion together with the stream of fluid injected from an orifice. The air thus introduced exhibits a greatest flow velocity near a smallest inner diameter section of the gradually reducing inner diameter portion. Under an action of the air whose flow velocity has become greatest, the molten metal is dispersed and turned to a multiplicity of fine liquid droplets in a reliable manner.

It is preferred that the restraint means is capable of adjusting a degree of restraint imposed on the orifice.

This makes it possible to stabilize the velocity of the fluid injected, thereby producing powder particles of a fine particle size.

It is preferred that the restraint means comprises a clamp for gripping and compressing the first member and the second member in a generally vertical direction.

This ensures that the first member and the second member are reliably compressed and enlargement of the orifice is restrained in a reliable manner, whereby the flow velocity of the fluid injected from the orifice can be kept nearly constant in a reliable manner.

It is preferred that the clamp includes two gripper pieces respectively arranged at a top region of the first member and at a bottom region of the second member and a connector portion for interconnecting the two gripper pieces, the connector portion capable of adjusting a spacing between the gripper pieces.

This ensures that the first member and the second member are reliably compressed and enlargement of the orifice is restrained in a reliable manner, whereby the flow velocity of the fluid injected from the orifice can be kept nearly constant in a reliable manner.

It is preferred that the clamp includes a plurality of clamps arranged around a center axis of the flow path with a predetermined spacing.

This makes it possible to uniformly compress the first member and the second member in a vertical direction, whereby the flow velocity of the fluid injected from the orifice can be kept nearly constant in more reliable manner.

It is preferred that the restraint means comprises a clamp for compressing the first member and the second member in a generally horizontal direction.

This makes it possible to uniformly compress the first member and the second member in a horizontal direction, whereby the flow velocity of the fluid injected from the orifice can be kept nearly constant in more reliable manner.

It is preferred that the clamp is adapted to generally uniformly tighten entire circumferences of outer periphery portions of the first member and the second member.

This makes it possible to uniformly compress the first member and the second member in a horizontal direction, whereby the flow velocity of the fluid injected from the orifice can be kept nearly constant in more reliable manner.

The above and other objects, features and advantages of the present invention will become apparent from the following description of preferred embodiments given in conjunction with the accompanying drawings.

DESCRIPTION OF EXEMPLARY EMBODIMENTS

Hereinafter, a metal powder production apparatus in accordance with the present invention will be described in respect of preferred embodiments shown in the accompanying drawings.

First Embodiment

Figure 1:
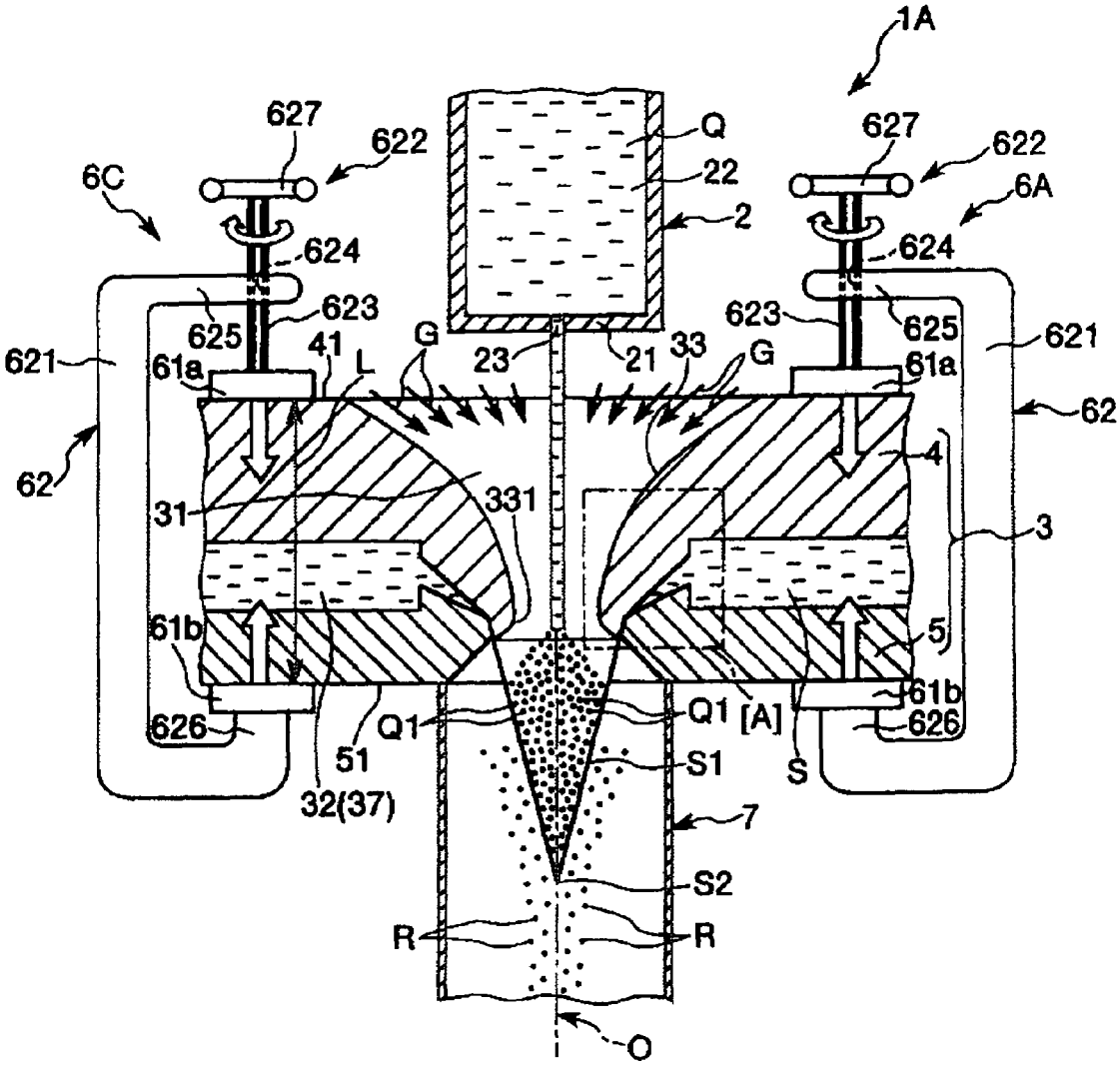
FIG. 1 is a vertical sectional view showing a metal powder production apparatus in accordance with a first embodiment of the present invention.
Figure 2:
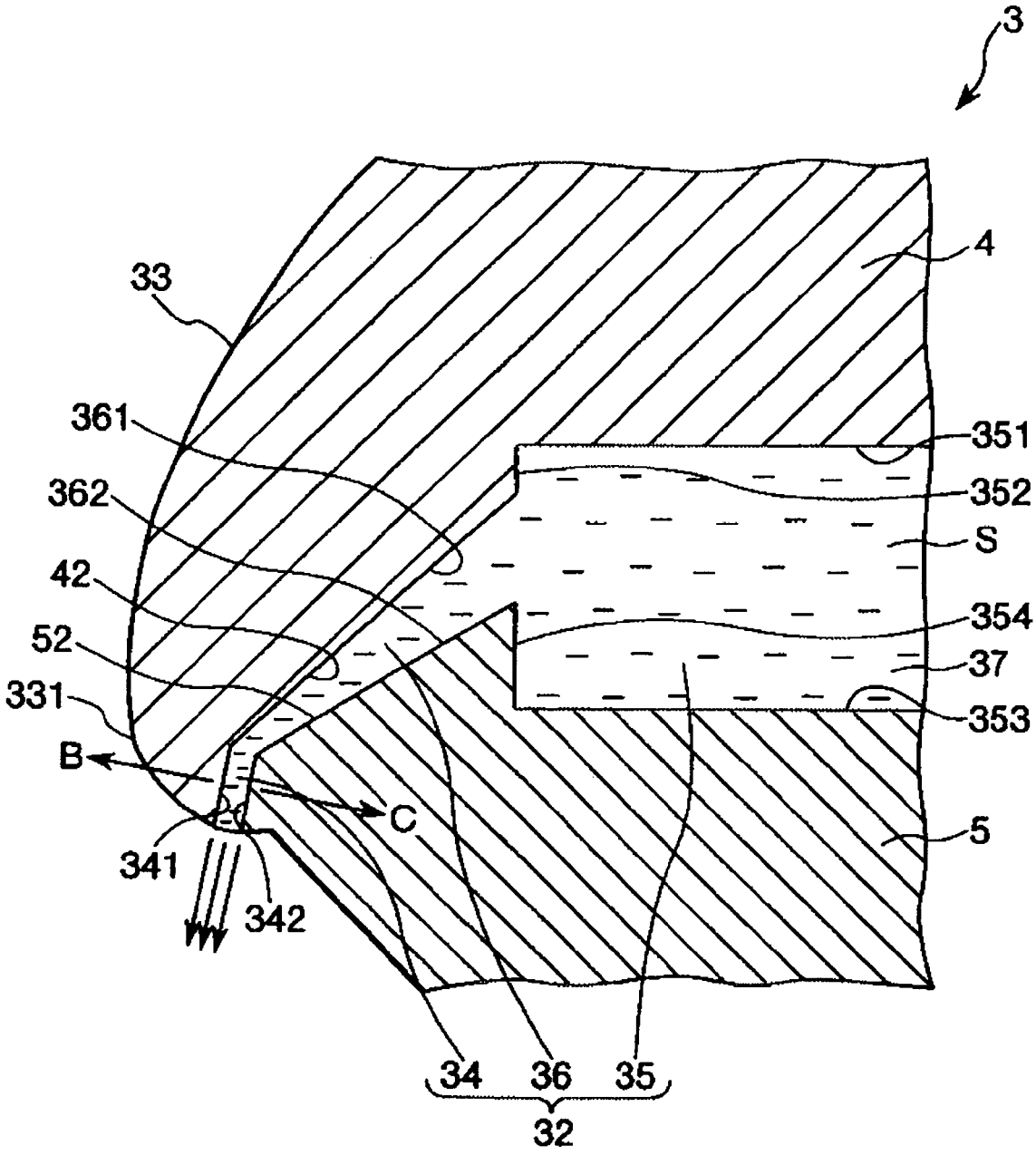
FIG. 2 is an enlarged detail view of a region [A] enclosed by a single-dotted chain line in FIG. 1.
Figure 3:
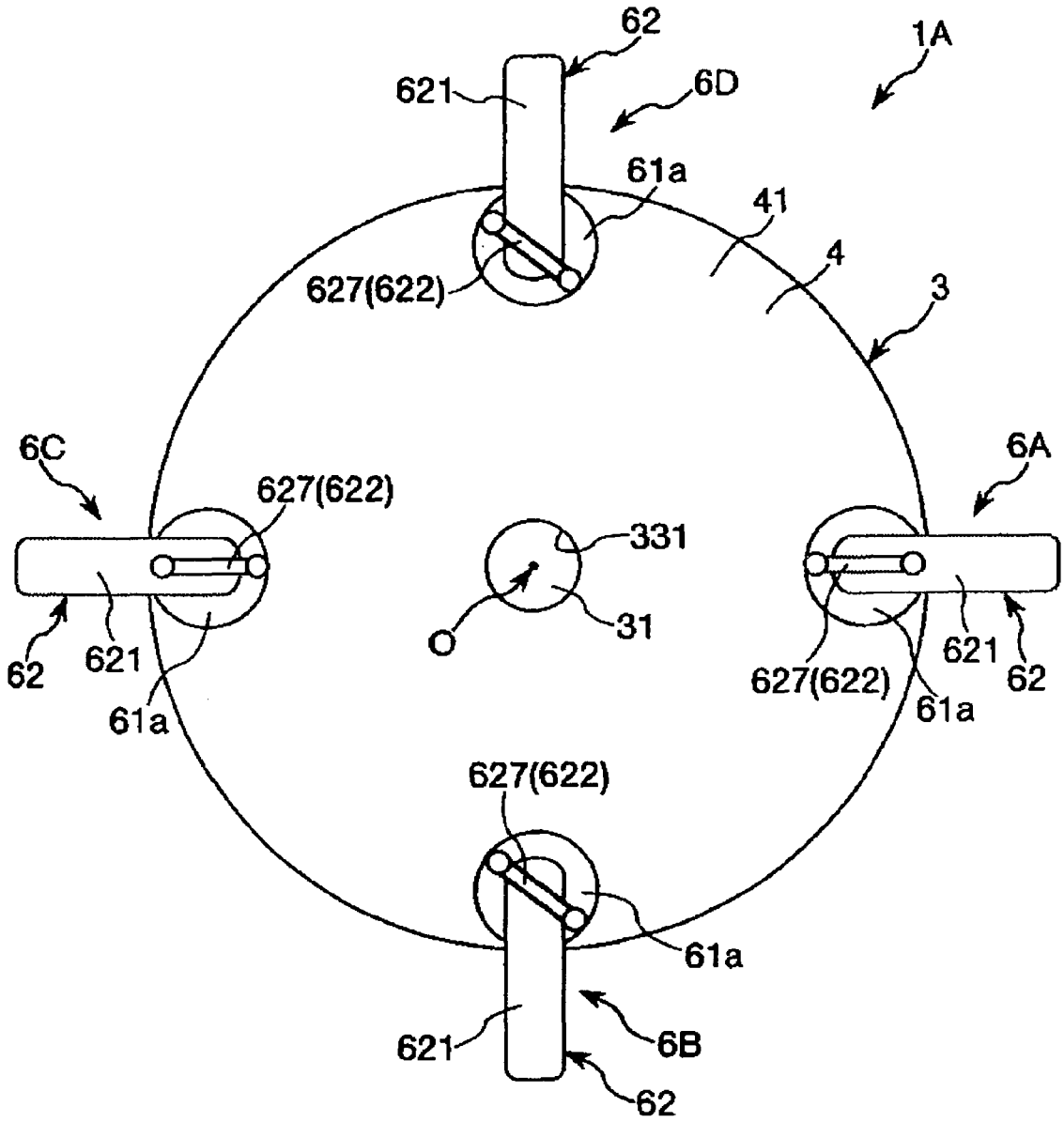
FIG. 3 is a plan (top) view of the metal powder production apparatus shown in FIG. 1.

FIG. 1 is a vertical sectional view showing a metal powder production apparatus in accordance with a first embodiment of the present invention, FIG. 2 is an enlarged detail view of a region [A] enclosed by a single-dotted chain line in FIG. 1, and FIG. 3 is a plan (top) view of the metal powder production apparatus shown in FIG. 1.

In the following description, the upper side in FIGS. 1 and 2 will be referred to as "top" or "upper" and the lower side will be referred to as "bottom" or "lower", only for the sake of better understanding. In FIG. 3, a supply part is omitted from illustration.

The metal powder production apparatus (atomizer) 1A shown in FIG. 1 is an apparatus that pulverizes molten metal Q by an atomizing method to obtain a multiplicity of metal powder particles R. The metal powder production apparatus 1A includes a supply part 2 for supplying the molten metal Q, a nozzle 3 provided below the supply part 2, clamps (restraint means) 6A, 6B, 6C and 6D attached to the nozzle 3 and a cover 7 attached to a bottom end surface 51 of the nozzle 3 (a second member 5).

Taken as an example in the present embodiment is a case that the metal powder production apparatus 1A produces metal powder particles R made of stainless steel (e.g., 304L, 316L, 17-4PH, 440C or the like) or Fe—Si-based magnetic material.

Now, description will be given to the configuration of individual parts.

As shown in FIG. 1, the supply part 2 has a portion of a bottom-closed tubular shape. In an internal space (cavity portion) 22 of the supply part 2, there is temporarily stored the molten metal Q (a molten material) obtained by mixing a simple substance of Co and a simple substance of Sn at a predetermined mol ratio (e.g., a mol ratio of 1:2) and melting them.

Furthermore, an ejection port 23 is formed at the center of a bottom portion 21 of the supply part 2. The molten metal Q in the internal space 22 is downwardly ejected from the ejection port 23.

The nozzle 3 is arranged below the supply part 2. The nozzle 3 is provided with a first flow path 31 through which the molten metal Q supplied (ejected) from the supply part 2 passes and a second flow path 32 through which water S supplied from a water source (not shown) for supplying fluid (water or liquid S in the present embodiment) passes.

The first flow path 31 has a circular cross-section and extends in a vertical direction at the center of the nozzle 3. The first flow path 31 is defined by an inner circumferential surface of the nozzle 3. The first flow path 31 has a gradually reducing inner diameter portion 33 of a convergent shape whose inner diameter is gradually decreased from a top end surface 41 of the nozzle 3 (a first member 4) toward the bottom thereof.

Thus, the air (gas) G subsisting above the nozzle 3 flows into (or is sucked up into) the gradually reducing inner diameter portion 33 (the first flow path 31) together with the stream of water (fluid) S injected from an orifice 34, which will be describe later. The air G thus introduced exhibits a greatest flow velocity near a smallest inner diameter section 331 of the gradually reducing inner diameter portion 33 (near a section at which the orifice 34 is opened). Under an action of the air G whose flow velocity has become greatest, the molten metal Q is dispersed and turned to a multiplicity of fine liquid droplets Q1 in a reliable manner.

As illustrated in FIG. 2, the second flow path 32 is formed of an orifice 34 opened toward a bottom end portion (the vicinity of the smallest inner diameter section 331) of the first flow path 31, a retention portion 35 for temporarily retaining the water S, and an introduction path (interconnecting path) 36 through which the water S is introduced from the retention portion 35 into the orifice 34.

The retention portion 35 is connected to the water source to receive the water S therefrom. The retention portion 35 communicates with the orifice 34 through the introduction path 36. Furthermore, the retention portion 35 has a vertical cross-section of a rectangular (or square) shape.

The introduction path 36 is a region whose vertical cross-section is of a wedge-like shape. This makes it possible to gradually increase the flow velocity of the water S flowing into the introduction path 36 from the retention portion 35 and, hence, to stably inject the water S with an increased flow velocity from the orifice 34.

The orifice 34 is a region at which the water S passed the retention portion 35 and the introduction path 36 in sequence is injected or spouted into the first flow path 31.

The orifice 34 is opened in a circumferential slit shape extending over the inner circumferential surface of the nozzle 3. Furthermore, the orifice 34 is opened in an inclined direction with respect to a center axis O of the first flow path 31.

By virtue of the orifice 34 formed in this manner, the water S is injected as a liquid jet S1 of a generally conical contour with an apex S2 thereof lying definitely at the lower side (see FIG. 1). This ensures that, in and inside the liquid jet S1, the molten metal Q is dispersed and turned to the multiplicity of fine liquid droplets Q1 in a reliable manner.

As set forth above, the molten metal Q is further dispersed and turned to the multiplicity of fine liquid droplets Q1 in a reliable manner, by the Air G whose flow velocity becomes greatest near the smallest inner diameter section 331 of the gradually reducing inner diameter portion 33. This generates a synergistic effect by which the molten metal Q is reliably dispersed and turned to the multiplicity of fine liquid droplets Q1 in more reliable manner.

The molten metal Q turned to the multiplicity of liquid droplets Q1 is cooled and solidified by making contact with the liquid jet S1, whereby a multiplicity of metal powder particles R are produced. The multiplicity of metal powder particles R thus produced are received in a container (not shown) arranged below the metal powder production apparatus 1A.

The nozzle 3 in which the first flow path 31 and the second flow path 32 are formed includes a first member 4 of a disk-like shape (ring-like shape) and a second member 5 of a disk-like shape (ring-like shape) arranged concentrically with the first member 4 (see FIGS. 1 and 2). The second member 5 is arranged below the first member 4 with a space 37 left therebetween.

The orifice 34, the introduction path 36 and the retention portion 35 are respectively defined by the first member 4 and the second member 5 arranged in this way. That is to say, the second flow path 32 is provided by the space 37 formed between the first member 4 and the second member 5.

As illustrated in FIG. 2, the orifice 34 has an inner circumferential surface 341 defined by a bottom end surface (end portion) 42 of the first member 4 and an outer circumferential surface 342 defined by a top end surface (end portion) 52 of the second member 5.

Likewise, the introduction path 36 has an upper surface 361 defined by the bottom end surface (end portion) 42 of the first member 4 and a lower surface 362 defined by the top end surface (end portion) 52 of the second member 5.

Moreover, the retention portion 35 has an upper surface 351 and an inner circumferential surface 352 lying above the introduction path 36, both of which are defined by the bottom end surface (end portion) 42 of the first member 4, and a lower surface 353 and an inner circumferential surface 354 lying below the introduction path 36, both of which are defined by the top end surface (end portion) 52 of the second member 5.

By defining the orifice 34, the introduction path 36 and the retention portion 35 in this manner, it is possible to easily and reliably form the orifice 34, the introduction path 36 and the retention portion 35 in the nozzle 3. Furthermore, the size of the orifice 34, the introduction path 36 and the retention portion 35 can be properly set in accordance with the size of the space 37.

Examples of a constituent material of the first member 4 and the second member 5 include, but are not particularly limited to, a variety of metallic materials. In particular, use of stainless steel is preferred, and use of Cr-based stainless steel or precipitation hardening stainless steel is more preferred.

As shown in FIG. 1, the cover 7 formed of a tubular body is fixedly secured to a bottom end surface 51 of the second member 5. The cover 7 is arranged concentrically with the first flow path 31. Use of the cover 7 makes it possible to prevent the metal powder particles R from flying apart as they fall down, whereby the metal powder particles R can be reliably received the container.

In the meantime, as depicted in FIGS. 1 and 3, four clamps 6A, 6B, 6C and 6D are provided at the edge of the nozzle 3. Each of the clamps 6A, 6B, 6C and 6D is adapted to grip and compress the first member 4 and the second member 5 in a generally vertical direction (up-and-down direction in FIG. 1).

Furthermore, the four clamps 6A, 6B, 6C and 6D are arranged along a perimeter of the nozzle 3, namely around the center axis O of the first flow path 31, with a predetermined spacing (at an equal angular spacing). This makes it possible to uniformly compress the first member 4 and the second member 5 in the vertical direction.

Inasmuch as the four clamps 6A, 6B, 6C and 6D have substantially the same configuration, only the clamp 6A will be representatively described in the following.

The clamp 6A includes two gripper pieces 61*a* and 61*b* and a connector portion 62 for interconnecting the two gripper pieces 61*a* and 61*b*. Each of the gripper pieces 61*a* and 61*b* is formed of a disk-like member.

The connector portion 62 is comprised of a connector portion main body 621 with a female thread 624 and an operating part 622 with a male thread 623 threadedly coupled with the female thread 624.

The connector portion main body 621 is of a generally "C"-like shape. The female thread 624 is formed at one end 625 of the connector portion main body 621. The gripper piece 61*b* is provided at the other end 626 of the connector portion main body 621.

The operating part 622 has a handle 627, on the opposing side of which the gripper piece 61*a* is provided.

The clamp 6A of this configuration is attached to the nozzle 3 in such a posture that the gripper pieces 61*a* and 61*b* are confronted with each other in an up-and-down direction. At this time, the gripper piece 61*a* is arranged at the edge region of the top end surface (top portion) 41 of the first member 4, while the gripper piece 61*b* is arranged at the edge region of the bottom end surface (bottom portion) 51 of the second member 5.

With the metal powder production apparatus 1A as configured above, when the water S is injected from the orifice 34, the inner circumferential surface 341 is pushed in the direction indicated by an arrow "B" and the outer circumferential surface 342 is pushed in the direction indicated by an arrow C, by the pressure of the water S passing through the orifice 34. Thus, the orifice 34 is urged to become enlarged. However, enlargement of the orifice 34 is prevented because the clearance (space) between the inner circumferential surface 341 and the outer circumferential surface 342 is restrained by the compressing action of the clamps 6A, 6B, 6C and 6D.

Accordingly, it is possible to maintain the size of the orifice 34 constant, whereby the flow velocity of the water S injected from the orifice 34 can be kept constant in a reliable manner.

In the respective clamps 6A, 6B, 6C and 6D, the spacing L between the gripper pieces 61*a* and 61*b* can be adjusted by rotatingly operating the handle 627. This makes it possible to reliably adjust the compression force acting against the nozzle 3, i.e., the degree of restraint imposed on the orifice 34. Thus, there is provided an advantage that powder of a fine particle size can be produced by stabilizing the flow velocity of an injected fluid.

As set forth above, the clamps 6A, 6B, 6C and 6D are arranged along a perimeter of the nozzle 3 with a predetermined spacing. This makes it possible to uniformly compress the first member 4 and the second member 5 in the vertical direction, whereby the flow velocity of the water S injected from the orifice 34 can be kept constant in a reliable manner.

Although four clamps are employed in the illustrated configuration, the number of clamps is not limited thereto and may be, e.g., two, three or more than five.

Furthermore, examples of a constituent material of the gripper pieces 61*a* and 61*b*, the connector portion main body 621 and the operating part 622 include, but are not particularly limited to, a variety of metallic materials or various kinds of plastics, which may be used independently or in combination.

Second Embodiment

Figure 4:
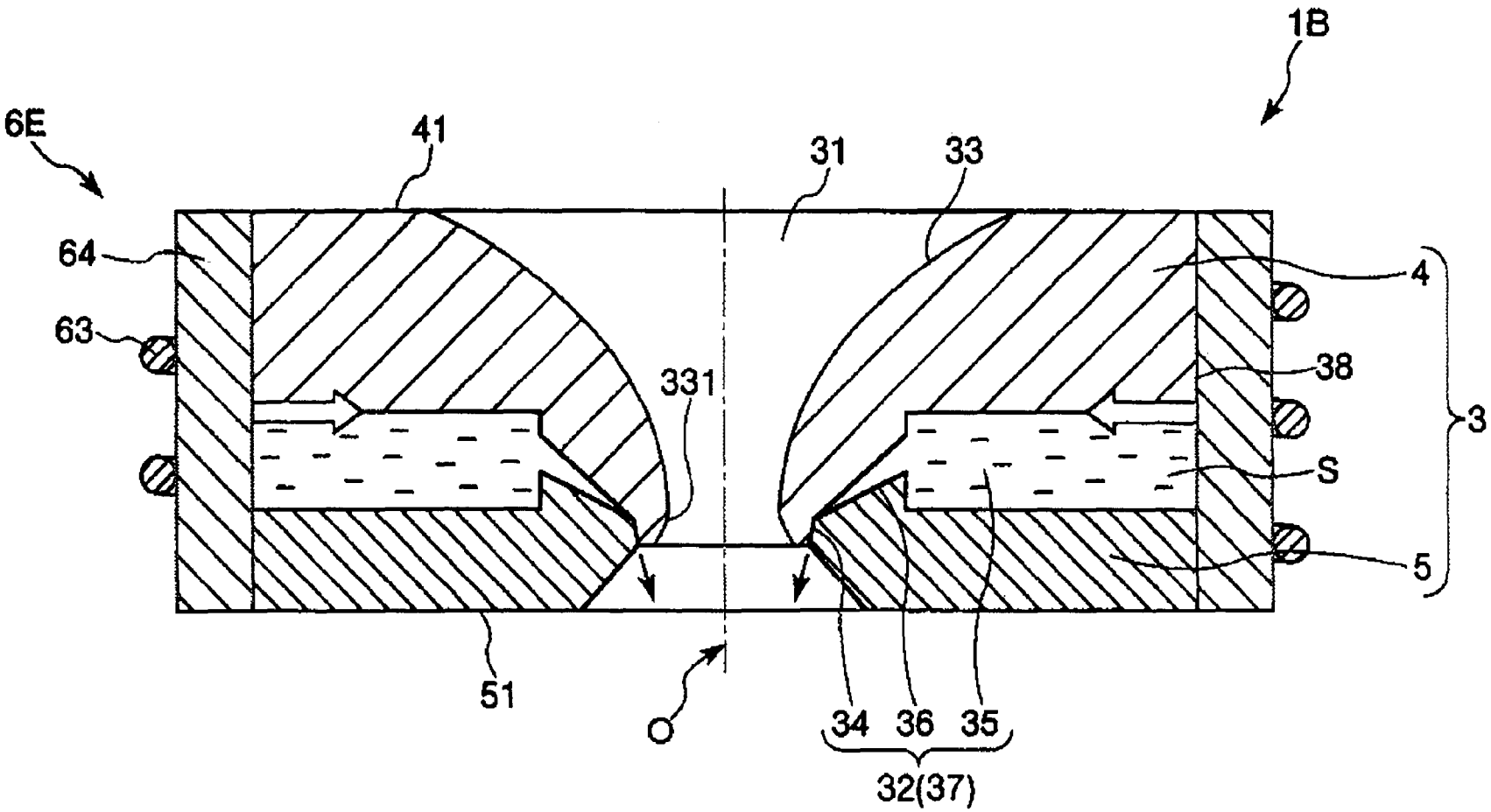
FIG. 4 is a vertical sectional view showing a metal powder production apparatus in accordance with a second embodiment of the present invention.
Figure 5:
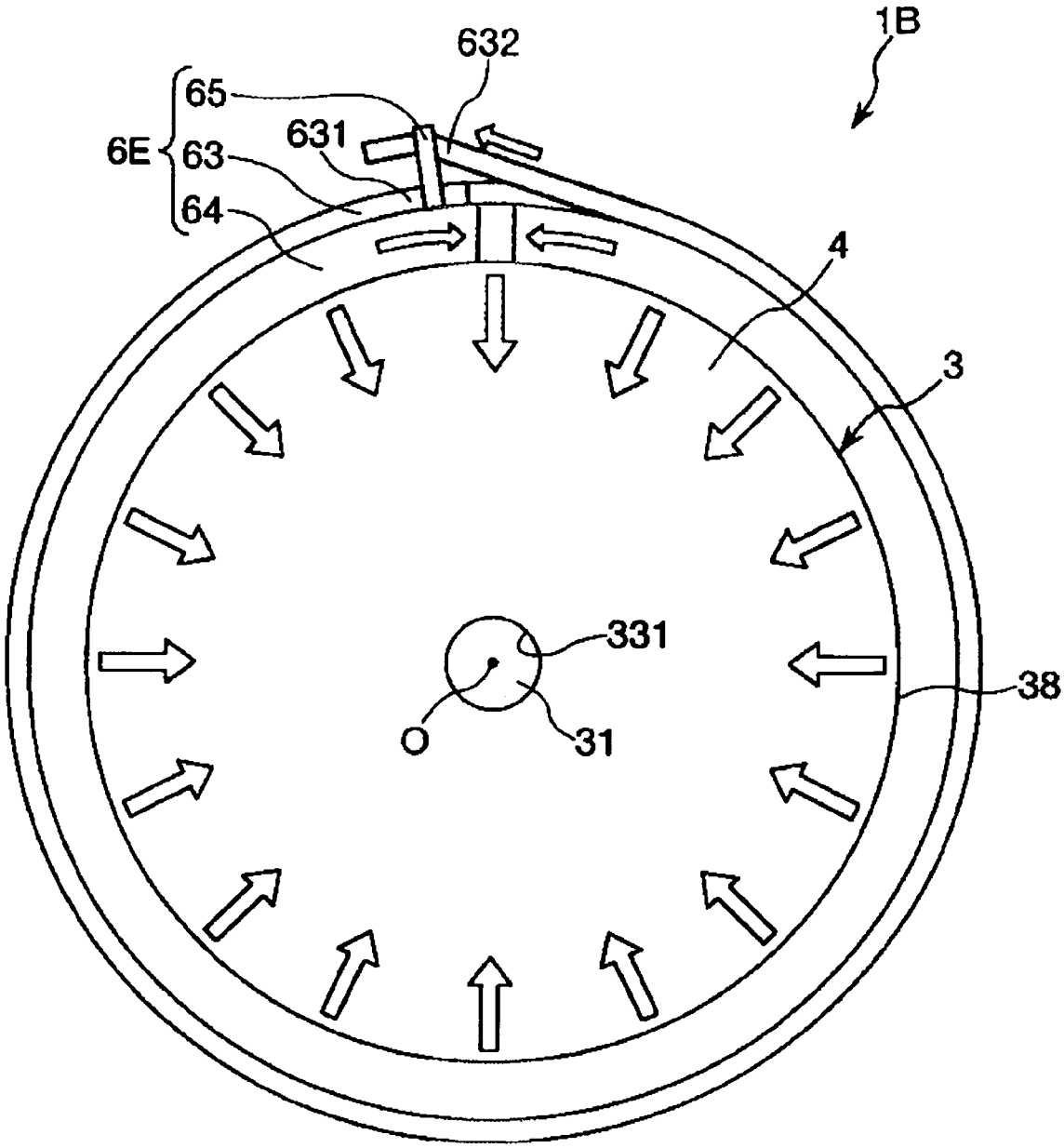
FIG. 5 is a plan (top) view of the metal powder production apparatus shown in FIG. 4.

FIG. 4 is a vertical sectional view showing a metal powder production apparatus in accordance with a second embodiment of the present invention, and FIG. 5 is a plan (top) view of the metal powder production apparatus shown in FIG. 4.

In the following description, the upper side in FIG. 4 will be referred to as "top" or "upper" and the lower side will be referred to as "bottom" or "lower", only for the sake of better understanding.

Hereinafter, a metal powder production apparatus in accordance with a second embodiment of the present invention will be described with reference to these figures. The following description will be centered on the points differing from the foregoing embodiment, with the same points omitted from description.

The present embodiment is the same as the first embodiment, except for difference in the configuration of a clamp.

The metal powder production apparatus 1B shown in FIGS. 4 and 5, includes a clamp (restraint means) 6E provided along an outer periphery portion 38 of the nozzle 3. The clamp 6E is adapted to compress the first member 4 and the second member 5 in a generally horizontal direction (in a left-right direction in FIG. 4).

As illustrated in FIG. 5, the clamp 6E includes a flexible linear body 63, a flexible band-like body 64 and a connector member 65 for joining one end 631 and the other end 632 of the linear body 63.

The band-like body 64 has a width substantially equal to the width (height) of the nozzle 3 and a length set slightly smaller than the length (circumference) of the outer periphery portion 38 of the nozzle 3. The band-like body 64 is provided in close contact with the outer periphery portion 38 of the nozzle 3.

The linear body 63 is formed of, e.g., a wire, and is wound around the band-like body 64 in multiple times.

The connector portion 65 is fixedly secured to one end 631 of the linear body 63 and is configured such that it can grip an arbitrary portion of the other end 632 of the linear body 63 and can maintain that portion in the gripped condition.

With the clamp 6E of such a configuration, the band-like body 64 is placed along the outer periphery portion 38 of the nozzle 3 and, then, the linear body 63 is wound around and tightened against the band-like body 64. In this state, the other end 632 of the linear body 63 is gripped by the connector portion 65. This makes it possible to uniformly tighten the nearly entire circumference of the outer periphery portion 38 of the nozzle 3, thereby reliably restraining any enlargement of the orifice 34.

Thus, it is possible to keep the size of the orifice 34 constant, whereby the flow velocity of the water S injected from the orifice 34 can be maintained constant in a reliable manner.

In the first embodiment described above, the operating parts 622 of the clamps 6A, 6B, 6C and 6D are operated one by one when compressing the nozzle 3. However, in the present embodiment, the task of compressing the nozzle 3 can be conducted merely by interconnecting the other end 632 of the linear body 63 and the connector portion 65. For this reason, the clamp 6E of the present embodiment makes it possible to easily and more uniformly compress the nozzle 3.

Examples of a constituent material of the linear body 63, the band-like body 64 and the connector portion 65 include a variety of metallic materials.

Although, in the illustrated configuration, the clamp 6E has one linear body 63 configured to collectively compress both the first member 4 and the second member 5, the present invention is not limited thereto. Alternatively, the clamp 6E may be provided with, e.g., two linear bodies configured to separately compress the first member 4 and the second member 5. Even if the clamp 6E has two linear bodies in this way, it is possible to easily and more uniformly compress the nozzle 3.

While the metal powder production apparatus of the present invention has been described hereinabove in respect of the illustrated embodiments, the present invention is not limited thereto. Individual parts constituting the metal powder production apparatus may be substituted by other arbitrary ones capable of performing like functions. Moreover, arbitrary constituent parts may be added if necessary.

Furthermore, the metal powder production apparatus of the present invention may be constructed by combining two or more arbitrary configurations (features) of the respective embodiments described above.

For example, the clamp of the second embodiment may be added to the nozzle of the first embodiment.

In addition, although the liquid (fluid) injected from the nozzle is water in the foregoing embodiments, the present invention is not limited thereto. The liquid may be, e.g., lipids or solvents.

What is claimed is:

1. A metal powder production apparatus comprising:

a supply part for supplying molten metal;

a nozzle provided below the supply part, the nozzle including a flow path defined by an inner circumferential surface of the nozzle through which the molten metal supplied from the supply part can pass, the flow path having a gradually reducing inner diameter portion whose inner diameter is gradually reduced in a downward direction, and an orifice opened at a bottom end of the flow path and adapted to inject fluid toward the flow path, the nozzle including a first member and a second member provided below the first member with a space left between the first member and the second member, wherein the orifice is defined by the first member and the second member; the orifice being opened in a circumferential slit shape extending over the entire inner circumferential surface of the nozzle; and a restraint means for restraining the orifice from being enlarged by the pressure of the fluid passing through the orifice, the restraint means provided on the nozzle, whereby the molten metal is dispersed and turned into a multiplicity of fine liquid droplets by bringing the molten metal passing through the flow path into contact with the fluid injected from the orifice of the nozzle, so that the multiplicity of fine liquid droplets are solidified to thereby produce metal powder.

2. The metal powder production apparatus as claimed in claim 1, wherein the orifice is configured to ensure that the fluid is injected in a generally conical contour with an apex lying at a lower side.

3. The metal powder production apparatus as claimed in claim 2, wherein the orifice has an inner circumferential surface defined by an end portion of the first member and an outer circumferential surface defined by an end portion of the second member.

4. The metal powder production apparatus as claimed in claim 1, wherein the nozzle further includes a retention portion for temporarily retaining the fluid and an introduction path for introducing the fluid from the retention portion to the orifice, the introduction path having a vertical cross-section of a wedge shape.

5. The metal powder production apparatus as claimed in claim 1, wherein the gradually reducing inner diameter portion is of a convergent shape.

6. The metal powder production apparatus as claimed in claim 1, wherein the restraint means is capable of adjusting a degree of restraint imposed on the orifice.

7. The metal powder production apparatus as claimed in claim 1, wherein the restraint means comprises a clamp for gripping and compressing the first member and the second member in a generally vertical direction.

8. The metal powder production apparatus as claimed in claim 7, wherein the clamp includes two gripper pieces respectively arranged at a top region of the first member and at a bottom region of the second member and a connector portion for interconnecting the two gripper pieces, the connector portion capable of adjusting a spacing between the gripper pieces.

9. The metal powder production apparatus as claimed in claim 7, wherein the clamp includes a plurality of clamps arranged around a center axis of the flow path with a predetermined spacing.

10. The metal powder production apparatus as claimed in claim 1, wherein the restraint means comprises a clamp for compressing the first member and the second member in a generally horizontal direction.

11. The metal powder production apparatus as claimed in claim 10, wherein the clamp is adapted to generally uniformly tighten entire circumferences of outer periphery portions of the first member and the second member.

12. The metal powder production apparatus as claimed in claim 1, wherein the supply part has a bottom portion and an ejection port formed at the center of the bottom portion, and the gradually reducing inner diameter portion has a smallest inner diameter section near the orifice, the metal powder production apparatus further comprising a linear flow path having one end and another end, the one end being connected to the ejection port form at the center of the bottom portion of the supply part, and the other end being opened in the smallest inner diameter section, wherein the molten metal is supplied from the smallest inner diameter section.

13. The metal powder production apparatus as claimed in claim 1, wherein the first member is constituted of a metallic material.

* * * * *